US006755520B2

(12) United States Patent
Godo et al.

(10) Patent No.: US 6,755,520 B2
(45) Date of Patent: Jun. 29, 2004

(54) CARD PRINTER

(75) Inventors: Hiroki Godo, Shiojiri (JP); Katsuyuki Endo, Matsumoto (JP); Hiroyuki Kato, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 96 days.

(21) Appl. No.: 10/111,998

(22) PCT Filed: May 15, 2001

(86) PCT No.: PCT/JP01/04060

§ 371 (c)(1),
(2), (4) Date: Sep. 23, 2002

(87) PCT Pub. No.: WO02/057088

PCT Pub. Date: Jul. 25, 2002

(65) Prior Publication Data

US 2003/0058321 A1 Mar. 27, 2003

(30) Foreign Application Priority Data

Jan. 17, 2001 (JP) ..... 2001-8706

(51) Int. Cl.[7] ..... B41J 29/13; B41J 3/36; B41J 2/01

(52) U.S. Cl. ..... 347/108; 347/104; 400/88

(58) Field of Search ..... 347/108, 104, 347/1, 109; 346/143, 145; 400/88, 691

(56) References Cited

U.S. PATENT DOCUMENTS

| | | | | | |
|---|---|---|---|---|---|
| 5,949,058 | A | * | 9/1999 | Kimura | 235/486 |
| 6,158,907 | A | * | 12/2000 | Silverbrook et al. | 400/88 |
| 6,241,332 | B1 | * | 6/2001 | Cummins et al. | 347/104 |
| 6,473,728 | B1 | * | 10/2002 | Tognazzini | 704/3 |

FOREIGN PATENT DOCUMENTS

| | | |
|---|---|---|
| JP | 63-854 | 1/1988 |
| JP | 2-231151 | 9/1990 |
| JP | 9-141954 | 6/1997 |
| JP | 10-230655 | 9/1998 |
| JP | 11-5341 | 1/1999 |

* cited by examiner

*Primary Examiner*—Stephen D. Meier
*Assistant Examiner*—Manish Shah

(57) ABSTRACT

A guide 63 for guiding a card 10 to a printing unit 50, and guides 62, 61 for guiding the card from the printing unit 50 to a storage chamber for temporary storage, are integrally formed to a frame 30 having an integrally formed opening-shaped mounting unit 32 for fastening a printing unit 50 for printing and transporting the card 10, and a flat mounting surface 31*c* for fastening a control board for controlling the printing unit 50. The card printer is configured by housing the frame 30 in cases 20, 40, but because the major members and components are integrally formed or fastened to the card 10, disassembly and assembly can be easily accomplished.

9 Claims, 9 Drawing Sheets

CARD PRINTER

FIELD OF TECHNOLOGY

The present invention relates to a card printer capable of printing on stiff cards such as prepaid cards.

1. Related Art

Information systems for centrally managing in one place information recorded to prepaid cards such as telephone cards, for example, have been developed in recent years, and a prepaid card usage count linked to the pass code assigned to the prepaid card is counted in this system.

In conjunction with this, card printers for recording information such as the pass code and usage count to prepaid cards are also being developed.

2. Summary of the Invention

Applications using such card printers in combination with credit card authorization terminals ("CAT" below) to issue prepaid cards with payment made by credit card have been proposed, but because the CAT is generally small, it is also desirable to make the card printer compact.

Furthermore, a problem with this type of card printer is that it must be able to transport stiff cards without slipping, and must prevent chafing the recording surface during transportation.

Furthermore, because prepaid cards are printed frequently and in large numbers, it is also necessary to consider the ease of disassembly and assembly for such as replacing and servicing the print head, control board, and other functional components. Yet further, it is also necessary to consider the ease of disassembly and assembly in order to remove a card when it becomes stuck in the part for temporarily holding the card.

The present invention is directed to a solution for these problems, and an object of the invention is to provide a card printer that is small and compact, can transport cards without slipping and without damaging the recording surface thereof, and is easy to handle.

A further object of the present invention is to provide a card printer that is easy to disassemble and assemble.

A card printer according to the present invention is a card printer comprising a printing unit having a print head for printing to a card, a roller for transporting the card, and a motor for driving the roller; a control board for controlling the printing unit; and a frame having an integrally formed opening-shaped mounting unit for installing the printing unit, and a flat mounting surface for installing the control board; integrally formed to the frame are a first guide disposed to an edge of the opening-shaped mounting unit for guiding the card between the print head and roller; a second guide disposed at a specific angle to the first guide on an edge on a side opposite the edge to which the first guide is disposed; and a third guide disposed proximally to the second guide for guiding a card transported by the roller to a back side of the flat mounting surface.

Because the printing unit for printing and transporting cards, the control board for controlling the printing unit, the guides for guiding cards transported by the printing unit, and other major members and components are integrally formed or fastened to the frame with the present invention, the major members and components can be removed en masse by opening the case and removing the frame from the case. That is, disassembly and assembly can be easily accomplished.

Furthermore, because the first guide disposed to an edge of the opening-shaped mounting unit for guiding the card between the print head and roller is inclined at a specific angle to the second guide disposed to an edge on a side opposite the edge to which the first guide is disposed, cards are transported wrapped a certain angle to the roller. Stiff cards can therefore be transported without slipping.

Further preferably, a wall forming part of a storage chamber for temporarily housing a card transported by the roller is disposed to the back side of the mounting surface provided for mounting the control board. When the roller is rotated to transport a card, the card guided by the second guide is further guided by a third guide to a storage chamber formed on the back side of the control board.

The case housing the frame comprises, for example, a top and bottom pair of cases. In this case the storage chamber is preferably formed between the bottom case and the wall of the frame. As a result, if a card becomes stuck in the storage chamber for some reason, the card can be easily removed from the storage chamber by removing the case from the frame.

Furthermore, the surface of the second guide preferably projects to said wall side from a printing surface defined by the print head and roller.

By projecting the second guide from the printing surface, the leading edge of the card curves to the wall (storage chamber ceiling) side of the frame. Therefore, the leading edge is urged to the wall side of the frame by the stiffness of the card itself as the card is transported to the storage chamber. As a result, the card is transported without the recording surface thereof being rubbed by members of the storage chamber. It should be noted that this wall is preferably formed substantially parallel to the printing surface in this case.

When the case for housing the frame is comprised of a top and bottom pair of cases, auxiliary guides such as shown below can be disposed to the top case.

For example, a comb-shaped fourth guide is preferably disposed to the top case so as to mesh alternately in part with the third guide when the frame is housed in the case. As a result, when a card is transported, the leading edge of the card guided by the second guide is guided to the storage chamber formed on the back side of the control box by both the third and fourth guides. It should be noted that in this case part of the fourth guide may be positioned opposite the second guide.

In addition, an insertion opening for inserting a card and a fifth guide positioned adjacent to the insertion opening can be disposed to the top case with the fifth guide positioned so that it is opposite the first guide when the frame is housed in the case.

In addition to the printing unit and guides for guiding cards transported thereby, detectors for detecting presence of a card may be disposed to the frame. These detectors can, for example, be disposed to the first guide or second guide.

BEST MODE FOR ACHIEVING THE INVENTION

A preferred embodiment of a card printer according to the present invention is described below with reference to the accompanying figures.

Figure 1:
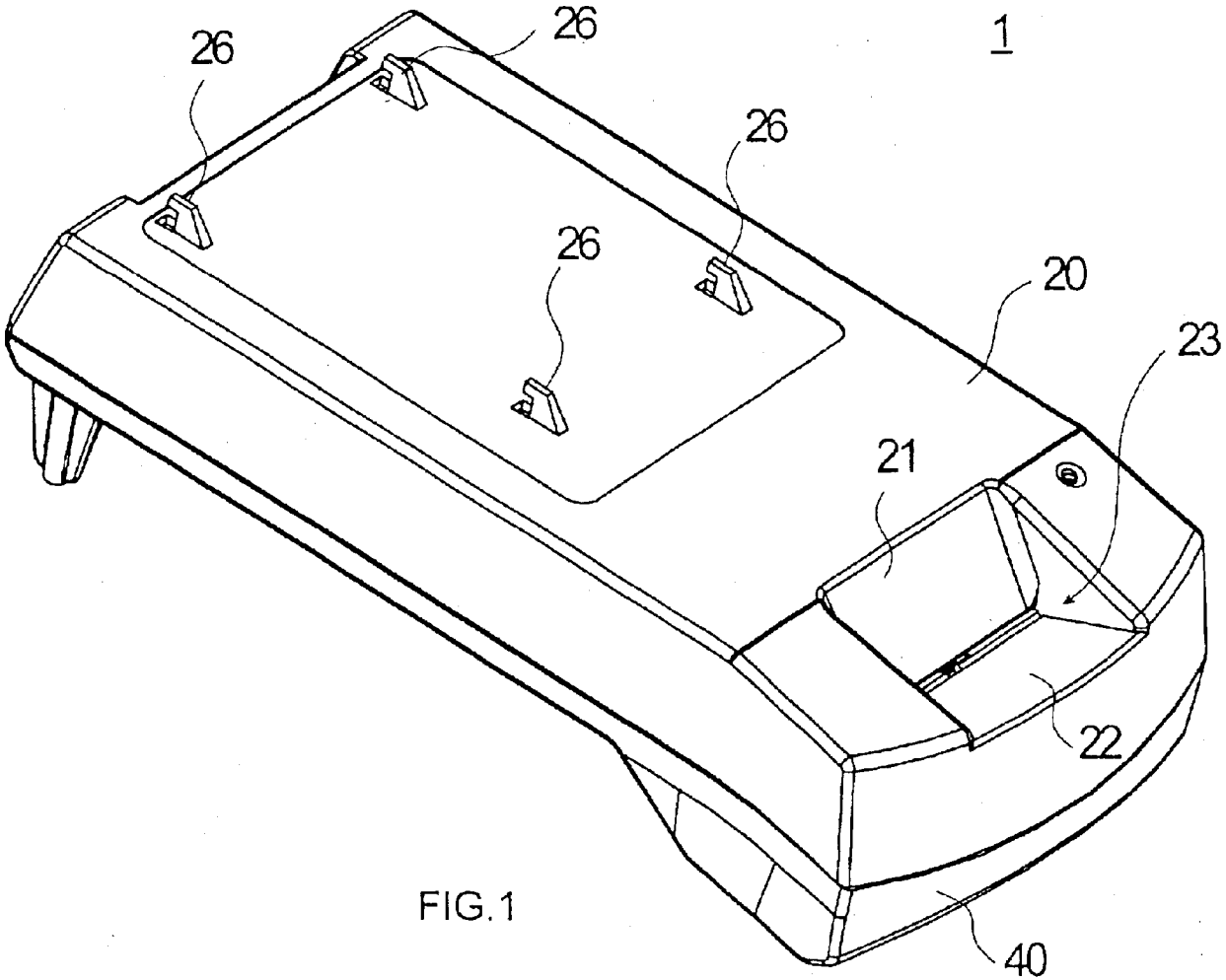
FIG. 1 is an oblique view showing the appearance of a card printer according to a preferred embodiment of the present invention.
Figure 2:
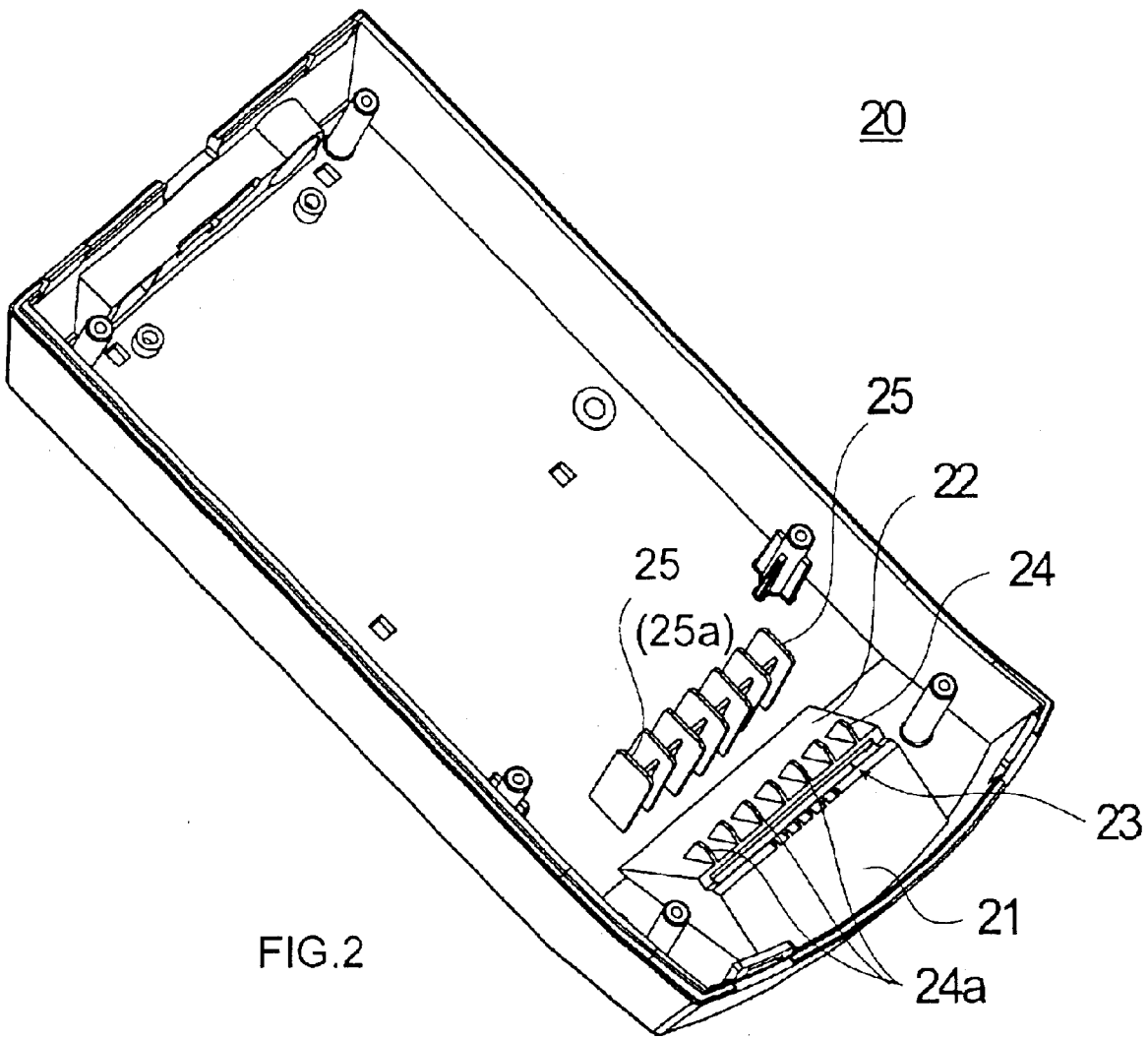
FIG. 2 is an oblique view looking at the inside of the top case of the card printer shown in FIG. 1.
Figure 3:
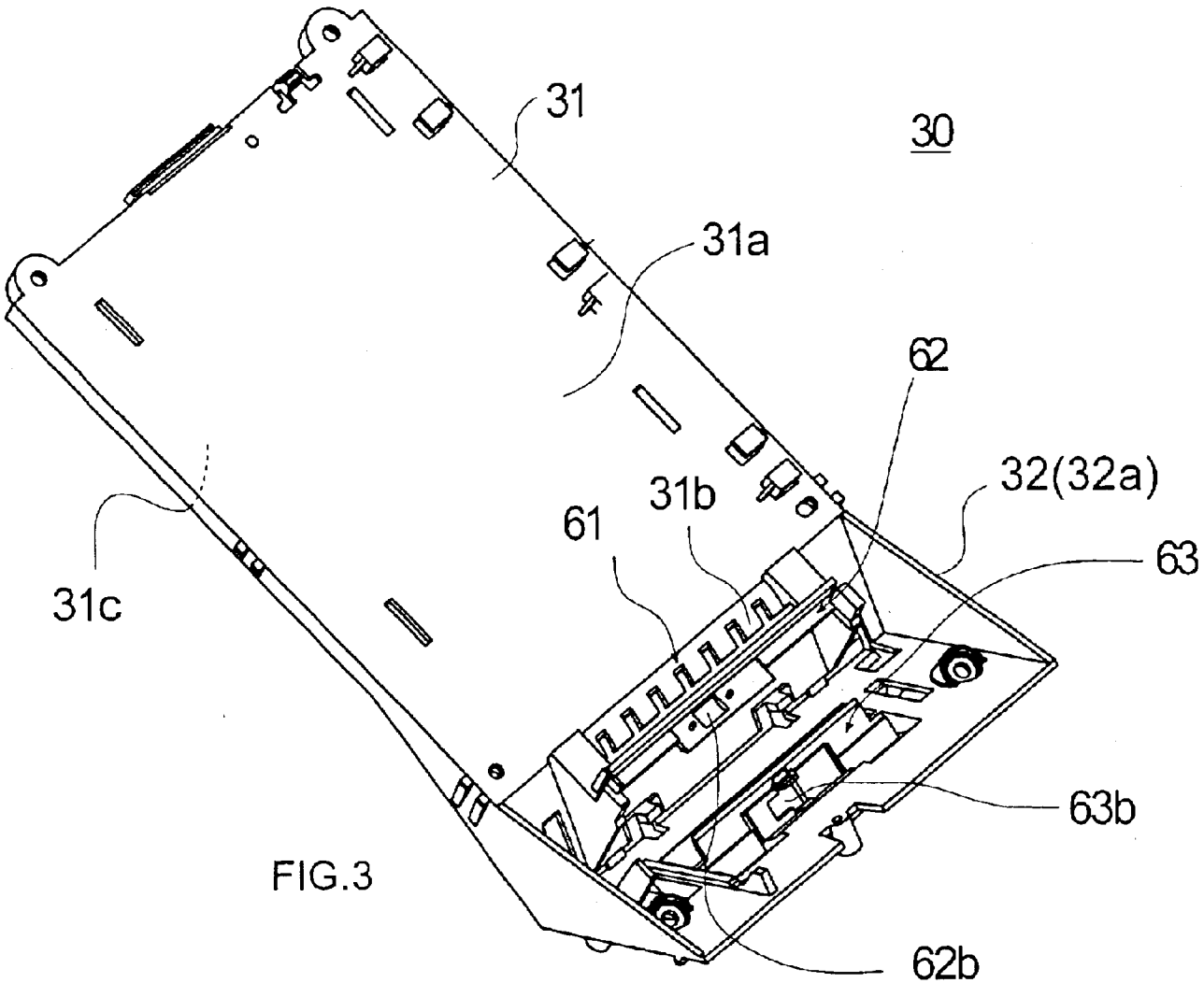
FIG. 3 is an oblique view looking at the bottom of the frame housed inside the card printer shown in FIG. 1.
Figure 4:
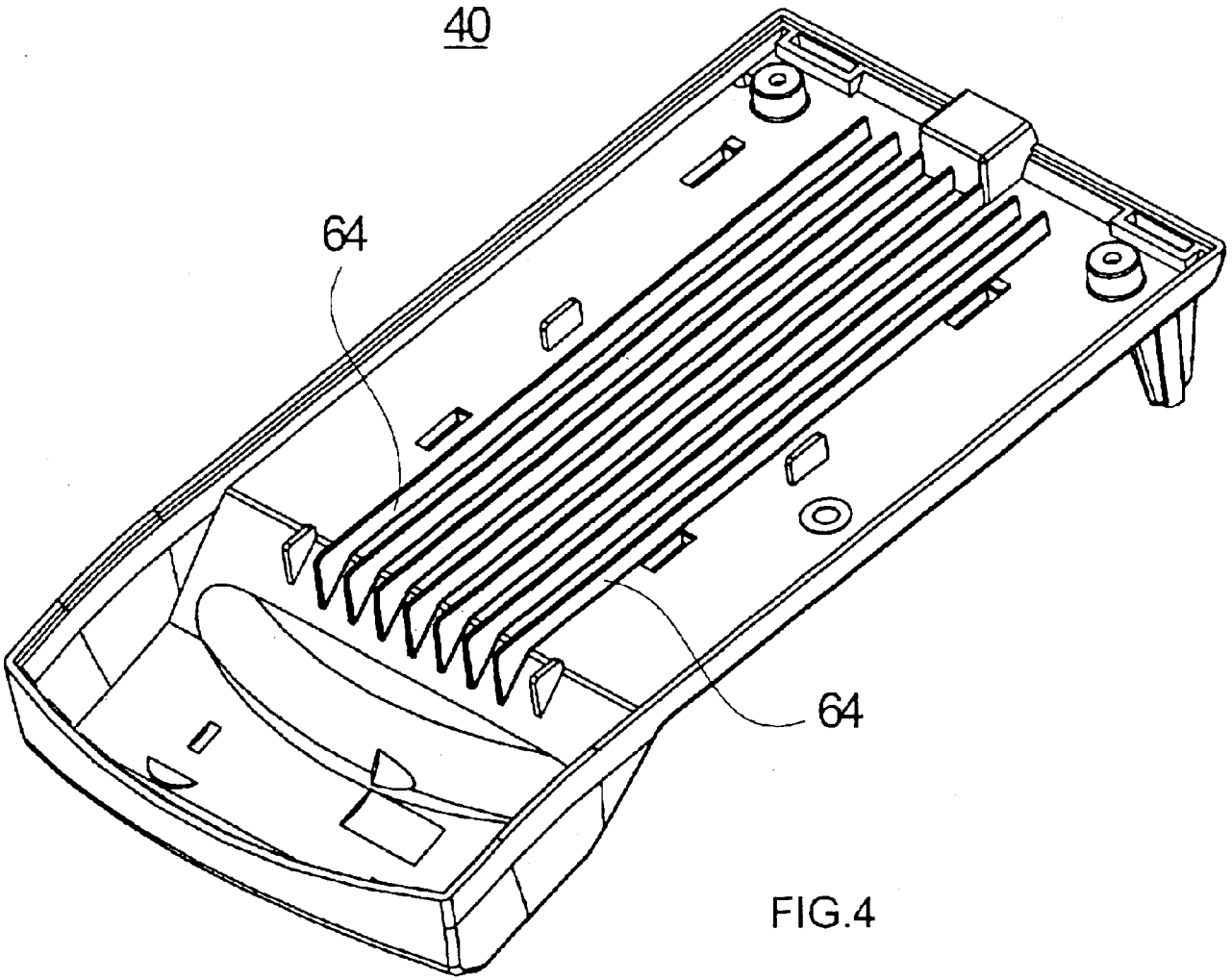
FIG. 4 is an oblique view looking at the inside of the bottom case of the card printer shown in FIG. 1.
Figure 5A:
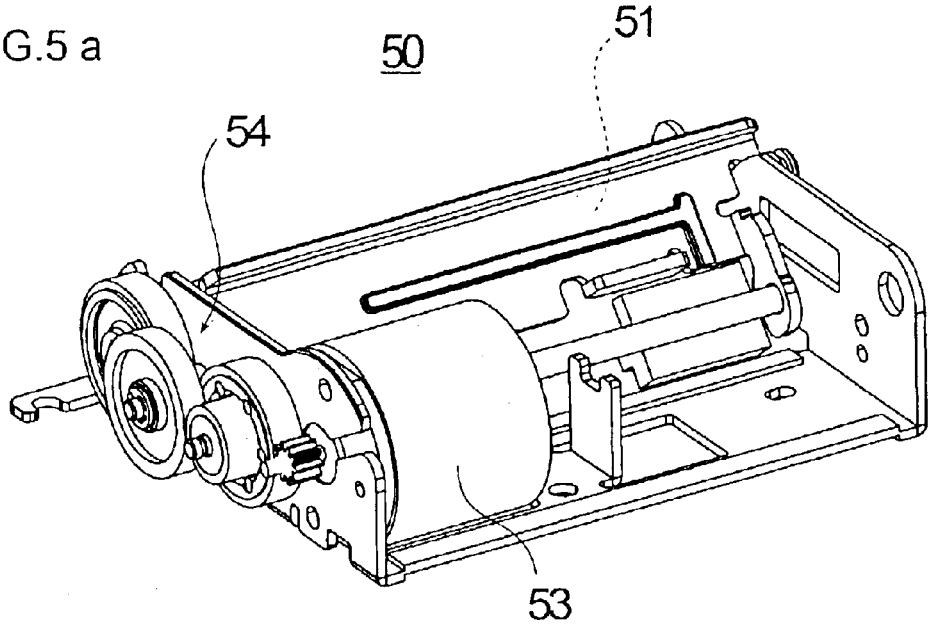
FIGS. 5(*a*) is an oblique view showing the basic configuration of the printing unit, and (*b*) is an oblique view showing the printing unit mounted to the frame shown in FIG. 3.
Figure 5B:
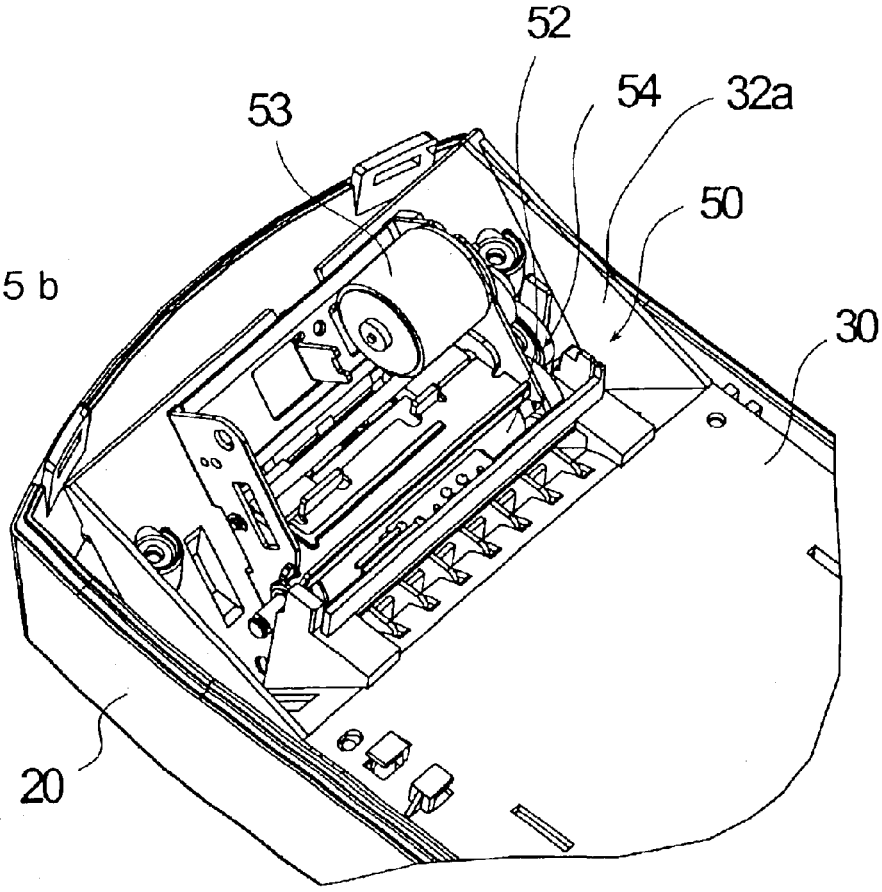

FIG. 1 is an oblique view showing the appearance of a card printer according to a preferred embodiment of the present invention. FIG. 2 is an oblique view showing the appearance of the top case of the card printer shown in FIG. 1 as seen from the inside. FIG. 3 is an oblique view showing the appearance of the frame housed inside the card printer shown in FIG. 1. FIG. 4 is an oblique view showing the appearance of the bottom case of the card printer shown in FIG. 1 as seen from the inside. FIG. 5(*a*) is an oblique view showing the basic configuration of the printing unit, and (*b*) is an oblique view showing the printing unit mounted to the frame shown in FIG. 3.

Figure 6:
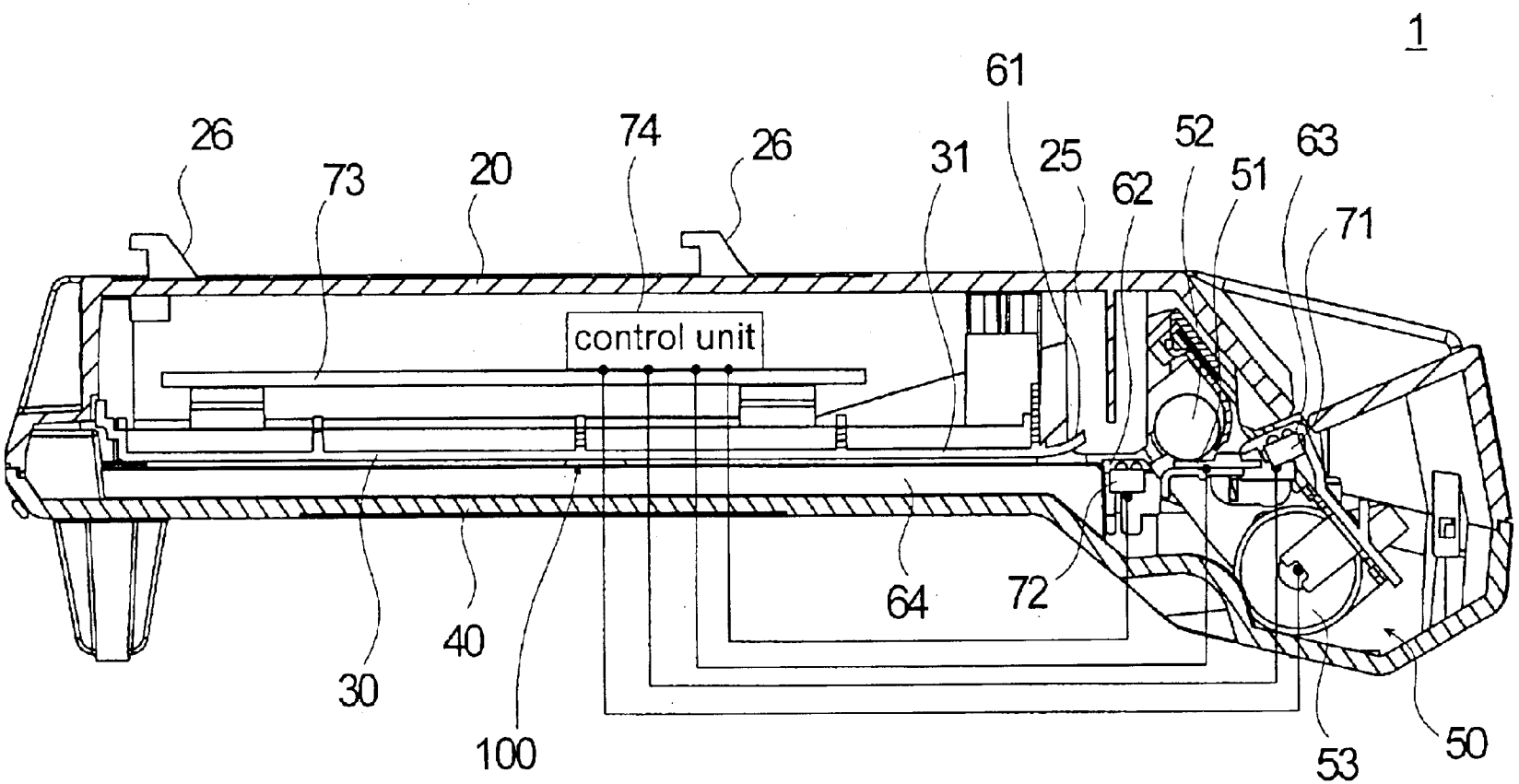
FIG. 6 is a side view showing the basic configuration of the card printer shown in FIG. 1.
Figure 7:
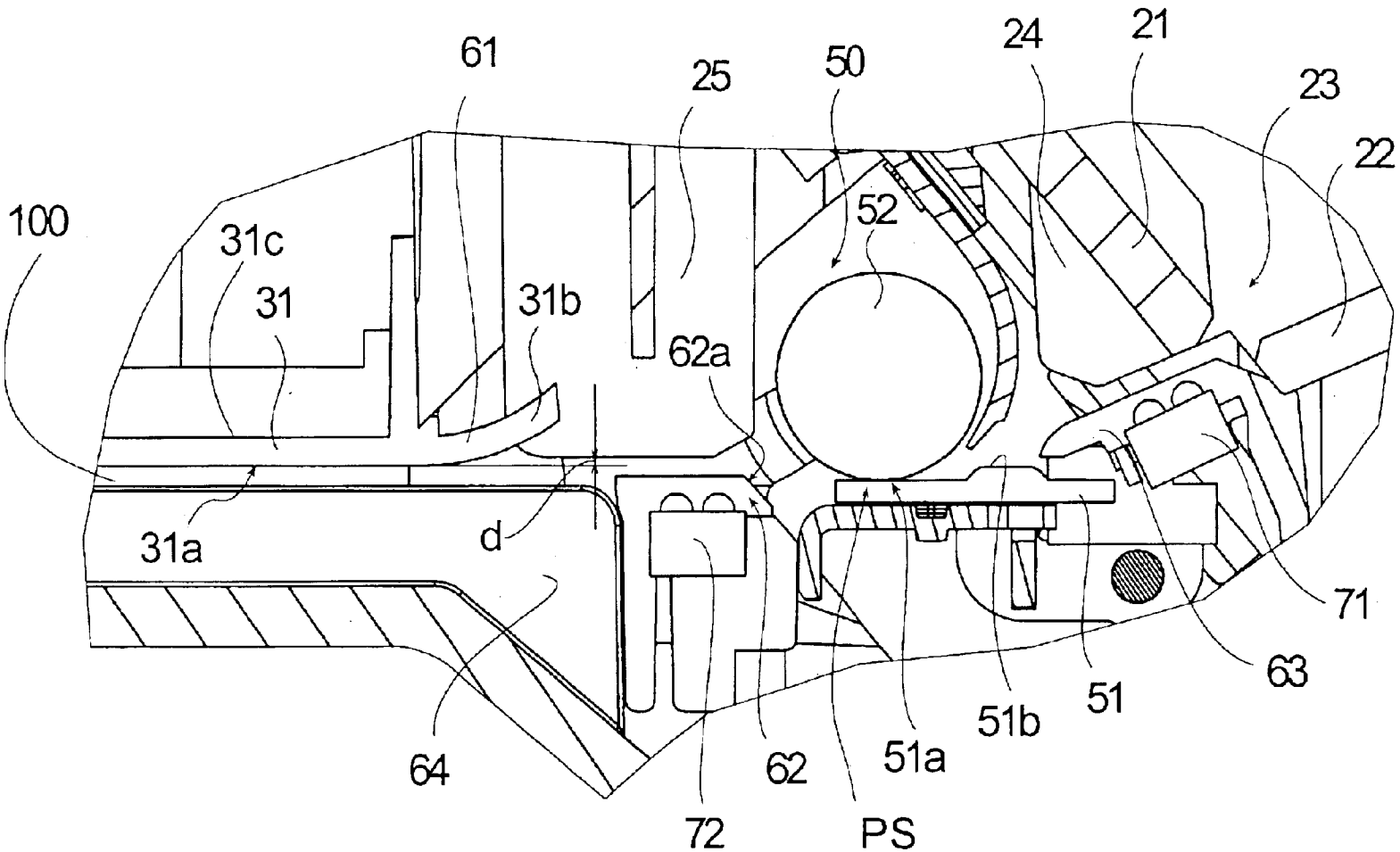
FIG. 7 is an enlarged view showing essential parts in FIG. 6.

FIG. 6 is a side view showing the basic configuration of the same card printer. FIG. 7 is an enlarged view showing essential parts in FIG. 6.

As shown in FIG. 1 to FIG. 4 and FIGS. 5(*a*) and (*b*), a card printer 1 according to this embodiment of the invention has a top case 20, frame 30, bottom case 40, and printing unit 50. The top case 20, frame 30, and bottom case 40 are formed so that when combined they form an integrated structure. It should be noted that the top case 20, frame 30, and bottom case 40 are molded from a resin such as ABS.

As shown in FIG. 1 or FIG. 2 the top case 20 is a box-like shape of a specific size. A card insertion opening 23 for inserting and ejecting cards is formed at the front (bottom right in FIG. 1) of the top case 20 by disposing an opening where a pair of flat wall surfaces 21, 22 join.

In this embodiment of the invention cards having a heat-sensitive layer laminated to a paper base of a specific size and coated with a plastic layer, including, for example, consecutive cards having a prepaid card part and a connected coupon. These cards have a property of being stiff, that is, they resist being bent with elastic force of a specific magnitude.

Guide 24 (fifth guide) and guide 25 (fourth guide) are formed on the back of the top case 20 integrally to the top case 20. Substantially triangular ribs 24*a* are disposed in a row near the card insertion opening 23, and guide 24 is formed by these ribs 24*a*. Squared teeth 25*a* are disposed in a row at a specific height at a place separated a specific distance from this auxiliary guide 24. A comb-like guide 25 is formed by these teeth 25*a*.

It should be noted that mounting claws 26 for mounting a certain terminal such as a CAT (not shown in the figure) equipped with the card printer are formed on the outside top of the top case 20.

As shown in FIG. 3 the frame 30 is a size able to cover the open part of the top case 20 and has a flat panel part 31 and a substantially V-shaped opening 32 formed contiguously/integrally to one end of the panel part 31. A mounting part 32*a* for installing the printing unit 50 described below is formed to this substantially V-shaped opening 32. In addition, the frame 30 can be fastened to the top case 20 using screws, for example.

A mounting surface 31*c* for securing a control board 73 (shown in FIG. 6) is formed on the back side of the panel part 31 as seen in FIG. 3, and a wall 31*a* that becomes the ceiling part of a storage chamber 100 for temporarily storing cards transported by the printing unit 50 is formed on the front side. The area of this wall 31*a* is defined as larger than the size of the card (the size of the prepaid card and the coupon).

A guide 61 (third guide) is formed at the interface between the panel part 31 and substantially V-shaped opening 32. That is, a plurality of claws 31*b* with a protruding curved shape is formed in this part, and these form the guide 61. The individual claws 31*b* are disposed so that when the frame 30 is mounted to the top case 20 they mesh with the teeth 25*a* of the comb-like guide 25. As a result, when a card is transported, the leading edge of the card transported from the printing unit 50 is guided to the storage chamber 100 formed on the back side of the control board 73 by both guide 61 and guide 25.

Along the edges of the substantially V-shaped opening 32 are disposed a guide 63 (first guide) for guiding a card inserted to the printing unit 50 mounted there, and a guide 62 (second guide) for guiding a card transported from the printing unit 50 to guide 61. Guide 63 is disposed to the edge on the side opposite the edge to which guide 62 is disposed. As shown in FIG. 7, the transportation path formed inside the printing unit 50 when the printing unit 50 is installed to the mounting part 32*a* is continuous to the transportation path defined by guide 63 and guide 62.

Moreover, as also shown in FIG. 7, mounting parts 63*b*, 62*b* for fastening paper sensors 71, 72 are disposed respectively to guides 63, 62 of the frame 30. The paper sensors 71, 72 fastened to the mounting parts 63*b*, 62*b* are configured to detect the presence of a card using a light reflection method, and output a specific signal. It should be noted that a paper sensor is disposed to both guides 62, 63 in this embodiment but can be disposed to only either guide.

It should be noted that guides 61, 62, 63 are formed integrally to the frame 30. That is, mounting parts 32*a*, 31*c* for installing the printing unit 50 and control board 73, main guides 61, 62, 63 for guiding cards transported by the printing unit 50, and mounting parts 63*b*, 62*b* for installing the paper sensors 71, 72, are formed integrally to the frame 30. Furthermore, while not shown in the figures, a mounting part for an LED for presenting the printer status (such as an error indicator) can also be disposed to the frame 30.

In addition, a cable guide for fastening signal cables for connecting control board 73 to functional components such as the printing unit 50 (motor 53, thermal head 51), paper sensors 71, 72, and LED can also be formed integrally to the frame 30.

By thus constructing the frame 30, the major members and components can be removed en masse by removing the frame 30 from the case after simply opening the top and bottom cases 20, 40. In other words, disassembly and assembly can be easily accomplished.

As shown in FIG. 1 or FIG. 4, the bottom case 40 is formed as a box-shaped piece of a size able to cover the frame 30 installed to the top case 20 and the printing unit 50 mounted thereto. In addition, the bottom case 40 is configured so that it can be installed to and removed from the top case 20 by insertion fitting.

A plurality of rectilinear parallel ribs 64 is disposed to this bottom case 40.

As shown in FIG. 7, the top of each rib 64 is at a position parallel to the wall 31*a* of frame 30 with a specific gap therebetween, and is disposed at a position adjacent to guide 62 of frame 30. The ribs 64 form a storage chamber 100 able to temporarily store a card in the space to the wall 31*a* of frame 30.

Next, as also shown in FIG. 7, when the top case 20 is mounted to the frame 30, the bottom of each tooth 25*a* of the comb-like guide 25 formed on the top case 20 is disposed substantially parallel to the wall 31*a* (ceiling of storage chamber 100) of frame 30. The guide 25 is defined so as to be recessed a slight distance d above wall 31*a*. In addition, part of the guide 25 is opposite guide 62 formed to frame 30.

As shown in FIGS. 5(*a*), (*b*) or FIG. 6, the printing unit 50 has a thermal head 51 with a flat head unit 51*a* comprising a specific heat-emitting element, and a platen roller 52 that turns in contact therewith to transport a card, and is configured so that power from the motor 53, which is a stepping motor, is transferred through a specific gear train 54 to this platen roller 52.

In the following description of the present embodiment the card transportation direction from the card insertion opening 23 toward the storage chamber 100 is called the "downstream direction," and the transportation direction opposite the downstream direction is the "upstream direction." In addition, the directions of rotation in which the platen roller 52 turns to transport a card in these directions are the "forward direction" and "reverse direction," respectively.

As shown in FIG. 7, when the frame 30 with this printing unit 50 mounted thereto is housed in the top case 20, the thermal head 51 and thermal head 51 are positioned near the card insertion opening 23 on the inside of the top case 20. Furthermore, the bottom part of the platen roller 52 is disposed at a position between guide 24 and guide 25 of top case 20 and projecting slightly therebelow.

The thermal head 51 is disposed so that the flat PS (below called the "printing surface") containing the surface of this head unit 51*a* is parallel to the wall 31*a* of the frame 30.

Furthermore, guide 62 is disposed at a position on the downstream direction side of the thermal head 51. This guide 62 is disposed with a specific gap to guide 25, and is disposed so as to project slightly from the printing surface of thermal head 51 toward the guide 25. Furthermore, an inclined surface 62*a* sloped at a specific angle is formed to this guide 62 from a position near the thermal head 51 toward guide 25.

In addition, guide 63 is disposed to the upstream direction side of the thermal head 51. The surface of this guide 63 is sloped at substantially the same angle as wall 22 disposed near the card insertion opening 23 of top case 20 so as to guide a card inserted along the wall 22 between thermal head 51 and platen roller 52.

Because guide 63 is thus inclined at substantially the same angle as the wall 22, the card curves between guide 62 and guide 63, and the card is thus transported wrapped to the platen roller 52.

It should be noted that a driver IC 51*b* for driving the heat-emitting element is disposed to this thermal head 51. This driver IC 51*b* is encased in resin and formed to a height that will not obstruct insertion of a card guided by guide 63 to the part where thermal head 51 and platen roller 52 contact.

A control unit 74 comprising, for example, a CPU and memory for storing a program, and a communication interface, for example, are mounted on the control board 73 fixed to mounting surface 31*c* of frame 30. This control board 73 is electrically connected to the paper sensors 71, 72, and is also electrically connected to motor 53 and thermal head 51. The control unit 74 of control board 73 is thus configured so that it can control the operation of motor 53 and driving thermal head 51 based on specific print data or signals sent from paper sensors 71, 72.

Furthermore, firmware recording a sequence for a printing process for driving the thermal head 51 while turning the motor 53 in the forward direction, and firmware recording a sequence for driving the motor 53 in the reverse direction without driving the thermal head 51 to eject a card from the card insertion opening 23, are recorded to this control unit 74.

The state changes whereby a card is transported in a card printer according to this embodiment of the invention are described below using FIG. 8 to FIG. 12.

Figure 8:
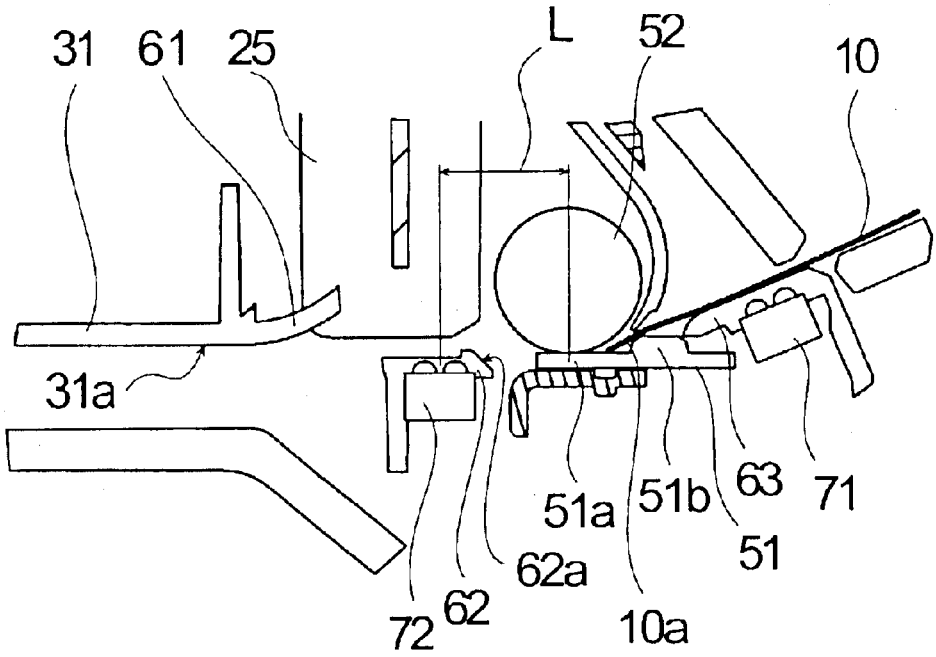
FIG. 8 is a descriptive view illustrating paper transportation in the card printer shown in FIG. 1, and shows a card inserted to the insertion opening.

As shown in FIG. 8, when a card 10 is held with the heat-sensitive side thereof facing down and the card 10 is inserted to the card insertion opening 23 of the printer 1, this card 10 is guided by guide 63 and the leading edge 10*a* of the card 10 comes between the thermal head 51 and platen roller 52. In this case the paper sensor 71 disposed to guide 63 sends a signal indicating detection of the card 10 to the control unit 74 of control board 73, and based thereon the control unit 74 operates the motor 53 and turns the platen roller 52 in the forward direction.

As a result, the platen roller 52 pulls the card 10 while bending it between guide 63 and thermal head 51 to the head unit 51*a* of thermal head 51, and transports it in the direction of guide 62. When the paper sensor 72 disposed to guide 62 detects the leading edge 10*a* of card 10, the control unit 74 turns the platen roller 52 in the reverse direction a pulse count equivalent to the distance L between the detection position of the paper sensor 72 and the heat-emitting element of the thermal head 51 to index the card 10 to the head unit 51*a* of the thermal head 51.

The control unit 74 then turns the platen roller 52 in the forward direction while driving the thermal head 51 to print content, including a pass code or usage count, for example, to a desired position on the card 10.

Figure 9:
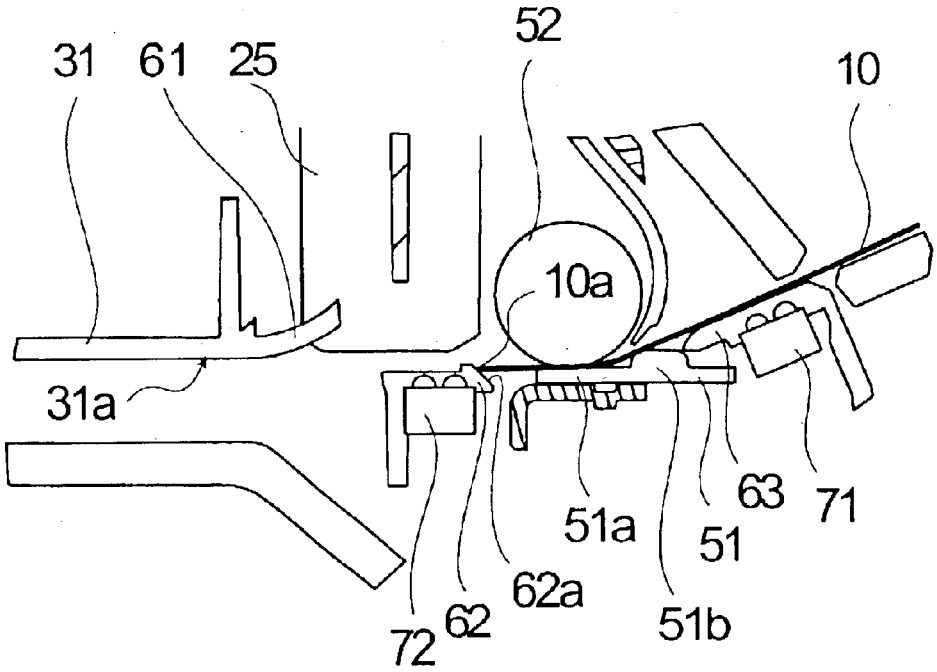
FIG. 9 is a descriptive view showing the leading edge of the card advanced to the second guide in FIG. 8.

When the card 10 is then transported from between platen roller 52 and thermal head 51 it proceeds along the printing surface and the leading edge 10*a* of card 10 contacts paper guide 62 as shown in FIG. 9.

Figure 10:
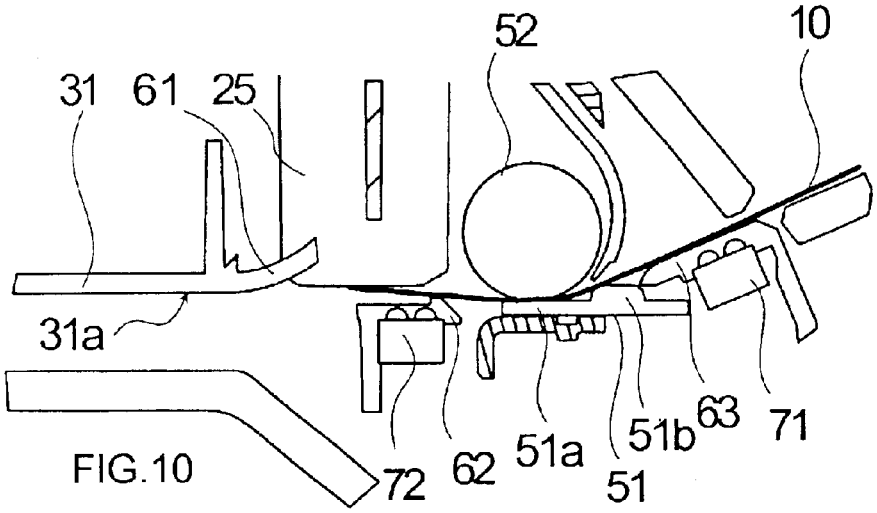
FIG. 10 is a descriptive view showing the leading edge of the card advanced to the fourth guide in FIG. 8.

As shown in FIG. 10, guide 62 guides the card 10 thus disposed so that the leading edge 10*a* is guided to guide 25 while the inclined guide surface 62*a* gradually deflects the card 10.

Because guide 62 supports the middle of the card 10 with force resisting the elastic force of the card 10 after the leading edge 10*a* of card 10 reaches guide. 25, the leading edge 10*a* of the card 10 thereafter advances along guide 25 while pressed against the guide 25. The card 10 is also transported wrapped a specific angle to the platen roller 52 between guide 62 and guide 63.

Figure 11:
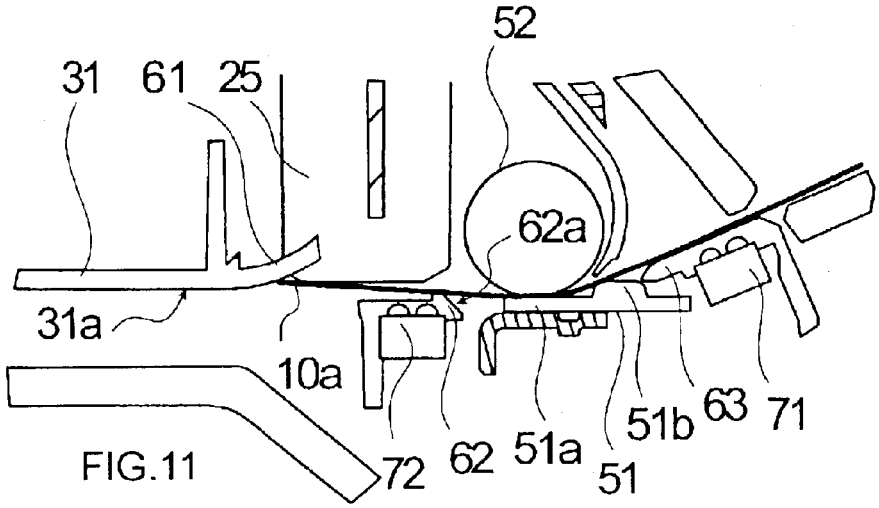
FIG. 11 is a descriptive view showing the leading edge of the card advanced to the third guide in FIG. 8.
Figure 12:
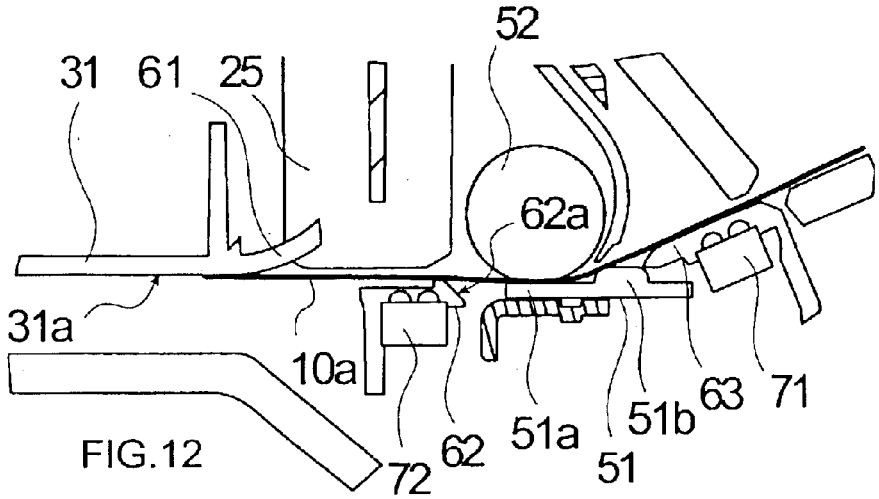
FIG. 12 is a descriptive view showing the leading edge of the card advanced to the storage unit in FIG. 8.

As shown in FIG. 11, when the leading edge 10*a* of card 10 advances in this manner to guide 61, it is guided along the surface of claws 31*b* formed in a curve to wall 31*a* of storage chamber 100 slightly below guide 25 as shown in FIG. 12.

When the leading edge 10*a* of card 10 then passes guide 61 and is guided to wall 31*a* of storage chamber 100, the card 10 is deflected slightly in the shape of a curved surface by the support from guide 62, and the force with which the leading edge 10*a* of card 10 pushes against wall 31*a* increases.

When the trailing end part of the card 10 reaches the thermal head 51, thermal stress is produced by the difference in the linear expansion coefficients of the top layer part (paper part) and the bottom layer part (plastic layer part) of the card 10 as a result of the environmental temperature, and the trailing end part of the card 10 wants to deflect to the side separating from the thermal head 51. However, because the card 10 is bent by the guide 62 and the leading edge 10*a* of card 10 is pressed against the wall 31*a*, it is difficult for the trailing end part of the card 10 to separate from the heat-emitting element of the thermal head 51.

Because guide 62 projects from the printing surface and guides the leading edge 10*a* of the card 10 to the guide 25 side and wall 31*a* projects slightly (distance d in FIG. 7) below the guide 25, the card can be deflected from the position where the leading edge 10*a* of the card 10 is passed the guide 61 so that the force pressing the leading edge 10*a* of card 10 against the wall 31*a* of the storage chamber 100 is increased.

The control unit 74 of control board 73 then stops driving the thermal head 51 after the specific printing is completed, and turns the platen roller 52 in the reverse direction to eject the card 10. The control unit 74 then counts a specific pulse count from the point at which a signal indicating there is no card 10 is received from paper sensor 72, and then stops motor 53 operation.

If the length of the card 10 in the transportation direction is relatively short in this continuous printing and paper transportation process, the card 10 will not contact the ribs 64 of the case 40, but even if a paper jam occurs for some reason with such a short card, such a card 10 will be received by the ribs 64.

By projecting guide 62 slightly toward guide 61 relative to the printing surface of the thermal head 51 so that the leading edge of the card is pressed against the wall 31*a* of the storage chamber 100 to transport the card 10 into the storage chamber using the stiffness of the paper stock of the card, the present embodiment as described above can prevent rubbing against the heat sensitive surface of the card. Furthermore, because warping that occurs easily at the trailing end of the card can be thus corrected and the card can be held in constant contact with the heat-emitting element of the thermal head 51, printing can be prevented from blurring.

In addition, the card can be gradually deflected and the leading edge of the card can be smoothly pressed against guides 25, 61 because an inclined surface 62*a* is formed on the guide 62 to guide the leading edge 10*a* of the card 10 to guides 25, 61.

Furthermore, because the card is transported between guide 62 and guide 63 so as to wrap to the platen roller 52 with the present embodiment, suitable print pressure can be achieved without being affected by rubber hardness when an elastomer is used for the platen roller 52, for example, and pressure produced at the leading edge of the card can be stabilized because constant tension can be maintained at the part where the card contacts the platen roller 52 and the part on the opposite side.

Yet further, because the ribs 64 are disposed to the bottom case 40 and this bottom case can be attached to and removed from the top case without using screws, for example, the present invention makes it simple to handle paper jams. Furthermore, the card can be ejected with the printed side down and the printed side of the card is covered by the bottom case 40 because the bottom case 40 is disposed on the thermal head 51 side, and the confidentiality of a pass code, for example, can thus be improved.

In addition, while it is possible to print while inserting or ejecting the card, this embodiment of the invention prints only when inserting the card and does not print when ejecting the card, and it is therefore possible to avoid interference with the printing process as a result of the operator pulling on the card as it is being ejected.

It should be noted that present invention shall not be limited to the above embodiment and can be modified in various ways.

For example, a thermal head 51 is used for the print head in the present embodiment, but the present invention can use an inkjet type print head under specific conditions. In this case, however, guides 61, 62, 63 are disposed in the same way as described above but a flat platen is used in place of platen roller 52 and a pair of paper transportation rollers is used on both the upstream and downstream sides of this platen. The inkjet head is then disposed with a specific gap to the printing surface defined by defined by this flat platen. Furthermore, the paper transportation rollers disposed in the downstream direction (the guide 62 side) from the inkjet head must be configured to meet such conditions preventing ink on the card from transferring to other parts after printing, such as using pinch rollers that hold only both edge parts of the card.

What is claimed is:

1. A card printer comprising:

a printing unit having a print head for printing to a card, a roller for transporting the card, and a motor for driving the roller;

a control board for controlling the printing unit; and a frame having an integrally formed opening-shaped mounting unit for installing the printing unit, and a flat mounting surface for installing the control board;

a first guide disposed to an edge of the opening-shaped mounting unit for guiding the card between the print head and roller;

a second guide disposed at a specific angle to the first guide on an edge on a side opposite the edge to which the first guide is disposed; and a third guide disposed proximally to the second guide for guiding a card transported by the roller to a back side of the flat mounting surface;

wherein said first, second and third guides are integrally formed to the frame.

2. A card printer as described in claim 1, further comprising a wall forming part of a storage chamber for temporarily housing a card transported by the roller, said wall disposed to the back side of the flat mounting surface.

3. A card printer as described in claim 2, further comprising a top and bottom pair of cases for housing the frame, the storage chamber being formed between said wall and the bottom case.

4. A card printer as described in claim 1, wherein the surface of the second guide projects to said wall side from a printing surface defined by the print head and roller.

5. A card printer as described in claim 4, wherein the printing surface and the wall are substantially parallel.

6. A card printer as described in claim 1, further comprising:

a top and bottom pair of cases for housing the frame, and a fourth guide disposed to the top case, wherein the fourth guide is formed in a comb shape so that the fourth guide is positioned to mesh alternately in part with the third guide when the frame is housed in the case.

7. A card printer as described in claim 6, wherein part of the fourth guide is positioned opposite the second guide when the frame is housed in the case.

8. A card printer as described in claim 1, further comprising:

a top and bottom pair of cases for housing the frame, an insertion opening for inserting a card, and a fifth guide positioned adjacent to the insertion opening, the insertion opening and the fifth guide being disposed to the top case, wherein the fifth guide is located opposite the first guide when the frame is housed in the case.

9. A card printer as described in claim 1, further comprising a detector for detecting presence of a card; the detector being disposed to the first guide or second guide.

* * * * *